US011299999B2

(12) United States Patent
Kim

(10) Patent No.: US 11,299,999 B2
(45) Date of Patent: Apr. 12, 2022

(54) APPARATUS FOR ADJUSTING CLEARANCE AND GAS TURBINE INCLUDING THE SAME

(71) Applicant: DOOSAN HEAVY INDUSTRIES & CONSTRUCTION CO., LTD., Changwon-si (KR)

(72) Inventor: Yeong Chun Kim, Changwon-si (KR)

( * ) Notice: Subject to any disclaimer, the term of this patent is extended or adjusted under 35 U.S.C. 154(b) by 135 days.

(21) Appl. No.: 16/895,220

(22) Filed: Jun. 8, 2020

(65) Prior Publication Data

US 2021/0040862 A1 Feb. 11, 2021

(30) Foreign Application Priority Data

Aug. 8, 2019 (KR) ..... 10-2019-0096861

(51) Int. Cl.

| | |
|---|---|
| ***F01D 11/22*** | (2006.01) |
| ***F01D 25/24*** | (2006.01) |
| ***F04D 29/046*** | (2006.01) |
| ***F01D 25/16*** | (2006.01) |

(52) U.S. Cl.

CPC ..... *F01D 11/22* (2013.01); *F01D 25/166* (2013.01); *F01D 25/24* (2013.01); *F04D 29/0462* (2013.01)

(58) Field of Classification Search

CPC ..... F01D 11/22; F01D 25/166; F01D 25/24; F04D 29/0462

See application file for complete search history.

(56) References Cited

U.S. PATENT DOCUMENTS 5,203,673 A * 4/1993 Evans ..... F01D 11/22 415/10
9,951,643 B2 * 4/2018 Duguay ..... F01D 25/24

FOREIGN PATENT DOCUMENTS

JP 1995004903 U 1/1995
KR 1020190075465 A 7/2019

* cited by examiner

*Primary Examiner* — Michael L Sehn
(74) *Attorney, Agent, or Firm* — Harvest IP Law, LLP

(57) ABSTRACT

A clearance adjusting apparatus to move a thrust bearing of a gas turbine back and forth to adjust a tip clearance of a turbine is provided. The clearance adjusting apparatus includes an adjusting plate disposed to move forward from or rearward to a reference surface, a biasing cylinder disposed to selectively move the adjusting plate back and forth, a stopper disposed to be moved toward the adjusting plate after being moved forward to prevent a rearward movement of the adjusting plate, a position sensor disposed to measure a distance from the reference surface to the adjusting plate, and a controller configured to receive information about measurements from the position sensor and control an operation of the stopper and the biasing cylinder based on the received information.

20 Claims, 12 Drawing Sheets

Axial displacement control chart

APPARATUS FOR ADJUSTING CLEARANCE AND GAS TURBINE INCLUDING THE SAME

CROSS REFERENCE TO RELATED APPLICATION

This application claims priority to Korean Patent Application No. 10-2019-0096861, filed on Aug. 8, 2019, the entire disclosure of which is incorporated herein by reference in its entirety.

BACKGROUND

1. Field

Apparatuses and methods consistent with exemplary embodiments relate to a clearance adjusting apparatus and a gas turbine including the same and, more particularly, to a clearance adjusting apparatus capable of moving a thrust bearing back and forth so that a tip clearance formed in a turbine is adjusted, and a gas turbine including the same.

2. Description of the Related Art

A gas turbine is a power engine that mixes air compressed in a compressor with fuel for combustion and rotates a turbine using high-temperature gas produced by the combustion. The gas turbine is used to drive a generator, an aircraft, a ship, a train, etc.

The gas turbine includes a compressor, a combustor, and a turbine. The compressor includes a plurality of compressor vanes and a plurality of compressor blades alternately arranged in a compressor casing with an air inlet through which air is introduced. The introduced air is compressed by the compressor vanes and the compressor blades while passing through an interior of the compressor.

The combustor mixes the compressed air compressed by the compressor with fuel and ignites a fuel-air mixture with an igniter to generate high-temperature and high-pressure combustion gas. The generated combustion gas is supplied to the turbine.

The turbine includes a plurality of turbine vanes and a plurality of turbine blades alternately arranged in a turbine casing. The turbine blades are rotated by the combustion gas to generate power and the combustion gas is discharged to the outside through a turbine diffuser.

The gas turbine further includes a tie rod. The tie rod is installed to centrally pass through a compressor disk with compressor blades coupled to an outer circumferential surface thereof, and a turbine disk with turbine blades coupled to an outer circumferential surface thereof. Accordingly, the tie rod allows the compressor disk and the turbine disk to be fixed to each other in the gas turbine.

A gas turbine does not have a reciprocating mechanism such as a piston which is usually provided in a typical a four-stroke engine. The gas turbine has no mutual friction portion such as a piston-cylinder, thereby having the advantages that consumption of lubricant is extremely low and an operational stroke which is relatively long in common reciprocating mechanisms is reduced. Therefore, the gas turbine has an advantage of high operation speed, thereby generating high-capacity power.

On the other hand, a tip clearance exists between a turbine casing and turbine blades. If the tip clearance is larger than a predetermined suitable range, an efficiency of a turbine decreases due to the large amount of combustion gas flowing between the turbine casing and the turbine blades. In contrast, if the tip clearance is less than a predetermined suitable range, in operation, an end of the turbine blade contacts an inner wall of the turbine casing, whereby wear occurs at that point. Therefore, it is important to maintain an optimal tip clearance of the turbine during operation of the gas turbine.

In order to adjust the tip clearance, a clearance adjusting apparatus designed to axially move the turbine disk back and forth is provided. In the clearance adjusting apparatus, a shaft part is disposed in front of a compressor disk and a thrust bearing is disposed around the shaft part such that the thrust bearing is moved back and forth so that the shaft part, the compressor disk, and the turbine disk are moved back and forth. This clearance adjusting apparatus moves the thrust bearing forward to reduce the tip clearance, and moves the thrust bearing rearward to increase the tip clearance.

However, according to this related art clearance adjusting apparatus, when the thrust bearing is moved forward/rearward, there is a limitation that the thrust bearing needs to be moved all the way to the front side regardless of the desired displacement and then moved back to the desired position. Therefore, according to the related art clearance adjusting apparatus, as illustrated in FIG. 1, an overshoot phenomenon in which the thrust bearing is moved forward beyond a distance to be originally moved occurs, and due to this overshoot phenomenon, the turbine casing and the turbine blade come into contact with each other, whereby wear occurs at that point.

SUMMARY

Aspects of one or more exemplary embodiments provide a clearance adjusting apparatus capable of moving a thrust bearing only by a desired amount in adjusting a tip clearance of a turbine, and a gas turbine including the same.

Additional aspects will be set forth in part in the description which follows and, in part, will become apparent from the description, or may be learned by practice of the exemplary embodiments.

According to an aspect of an exemplary embodiment, there is provided a clearance adjusting apparatus to move a thrust bearing of a gas turbine back and forth to adjust a tip clearance of a turbine, the clearance adjusting apparatus including: an adjusting plate disposed on the thrust bearing to move forward from or rearward to a reference surface; a biasing cylinder disposed on a rear side of the adjusting plate to selectively move the adjusting plate back and forth; a stopper disposed adjacent to the adjusting plate to be moved toward the adjusting plate after being moved forward to prevent a rearward movement of the adjusting plate; a position sensor disposed on the biasing cylinder to measure a distance from the reference surface to a rear surface of the adjusting plate; and a controller configured to receive information about measurements from the position sensor and control an operation of the stopper and the biasing cylinder based on the received information.

The biasing cylinder may include a housing, a division part disposed inside the housing to reciprocate back and forth such that the division part is arranged to divide an interior space of the housing into a front space and a rear space, and a biasing part connected between a front side of the division part and a rear surface of the adjusting plate to move the adjusting plate back and forth.

The position sensor may be disposed in front of the housing.

The biasing cylinder may further include a front supply part and a rear supply part through which a fluid flows into and out of the front space and the rear space, respectively, and the controller may be configured to supply a fluid to the rear space through the rear supply part if the division part is to be moved forward and to supply a fluid to the front space through the front supply part if the division part is to be moved rearward.

The stopper may be disposed under the adjusting plate such that a rear surface thereof is placed on the reference surface, the stopper having a front stepped surface on which a plurality of step faces are formed at different distances from the reference surface, and the controller may be configured to seat the adjusting plate on a target step face by moving the adjusting plate forward, raising the stopper, and moving the adjusting plate rearward.

The stopper may be configured such that an underlying step face protrudes more forward from an overlying step face thereof, and the controller may be configured to select, from the step faces of the stopper, a step face having a distance from the reference surface corresponding to a target displacement of the adjusting plate from the reference surface, and seat the adjusting plate on the selected step face.

The controller may be configured to stop the forward movement of the adjusting plate and raise the stopper if a distance from the reference surface to the rear surface of the adjusting plate is greater than a distance from the reference surface to the selected step face and is smaller than a distance from the reference surface to the step face disposed below the selected step face.

The controller may be configured to raise the stopper such that an upper surface of the step face below the selected step face becomes flush with a lower surface of the adjusting plate, and move the adjusting plate rearward so that the adjusting plate is seated on the selected step face.

The clearance adjusting apparatus may further include a fastening member disposed under the adjusting plate and having a stepped surface with a plurality of step contact faces to be selectively brought into contact with the plurality of step faces of the stopper, respectively.

The clearance adjusting apparatus may further include a fastening bolt to fasten the fastening member and the adjusting plate together through the adjusting plate.

According to an aspect of another exemplary embodiment, there is provided a gas turbine including: a compressor including a compressor stator into which air is externally introduced and a compressor rotor disposed in the compressor stator to compress the air; a combustor configured to mix the compressed air with fuel and combust the air and fuel mixture; a turbine including a turbine stator through which the combustion gas supplied from the combustor flows and a turbine rotor disposed in the turbine stator to rotate with the combustion gas flowing therethrough; a shaft disposed in front of the compressor rotor; a thrust bearing disposed around an outer circumferential surface of the shaft; and a clearance adjusting apparatus disposed on the thrust bearing to move the thrust bearing back and forth so that the shaft, the compressor rotor, and the turbine rotor are moved back and forth, wherein the clearance adjusting apparatus may include: an adjusting plate disposed on the thrust bearing to move forward from or rearward to a reference surface; a biasing cylinder disposed on a rear side of the adjusting plate to selectively move the adjusting plate back and forth; a stopper disposed adjacent to the adjusting plate to be moved toward the adjusting plate after being moved forward to prevent a rearward movement of the adjusting plate; a position sensor disposed on the biasing cylinder to measure a distance from the reference surface to a rear surface of the adjusting plate; and a controller configured to receive information about measurements from the position sensor and control an operation of the stopper and the biasing cylinder based on the received information.

The biasing cylinder may include: a housing; a division part disposed inside the housing to reciprocate back and forth such that the division part is arranged to divide an interior space of the housing into a front space and a rear space; and a biasing part connected between a front side of the division part and a rear surface of the adjusting plate to move the adjusting plate back and forth.

The position sensor may be disposed in front of the housing.

The biasing cylinder may further include a front supply part and a rear supply part through which a fluid flows into and out of the front space and the rear space, respectively, and the controller may be configured to supply a fluid to the rear space through the rear supply part if the division part is to be moved forward and to supply a fluid to the front space through the front supply part if the division part is to be moved rearward.

The stopper may be disposed under the adjusting plate such that a rear surface thereof is placed on the reference surface, the stopper having a front stepped surface on which a plurality of step faces are formed at different distances from the reference surface, and the controller may be configured to seat the adjusting plate on a target step face by moving the adjusting plate forward, raising the stopper, and moving the adjusting plate rearward.

The stopper may be configured such that an underlying step face protrudes more forward from an overlying step face thereof, and the controller may be configured to select, from the step faces of the stopper, a step face having a distance from the reference surface corresponding to a target displacement of the adjusting plate from the reference surface, and seat the adjusting plate on the selected step face.

The controller may be configured to stop the forward movement of the adjusting plate and raise the stopper if a distance from the reference surface to the rear surface of the adjusting plate is greater than a distance from the reference surface to the selected step face and is smaller than a distance from the reference surface to the step face disposed below the selected step face.

The controller may be configured to raise the stopper such that an upper surface of the step face below the selected step face becomes flush with a lower surface of the adjusting plate, and move the adjusting plate rearward so that the adjusting plate is seated on the selected step face.

The clearance adjusting apparatus may further include a fastening member disposed under the adjusting plate and having a stepped surface with a plurality of step contact faces to be selectively brought into contact with the plurality of step faces of the stopper, respectively.

The clearance adjusting apparatus may further include a fastening bolt to fasten the fastening member and the adjusting plate together through the adjusting plate.

In the clearance adjusting apparatus and the gas turbine having the same according to one or more exemplary embodiments, an overshoot phenomenon is prevented from occurring by measuring the displacement of the adjusting plate using the position sensor in real time, and controlling the movement of the adjusting plate based on the measurements. Therefore, the tip clearance of the turbine can be optimally maintained, and an overall driving efficiency of the gas turbine can be improved.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
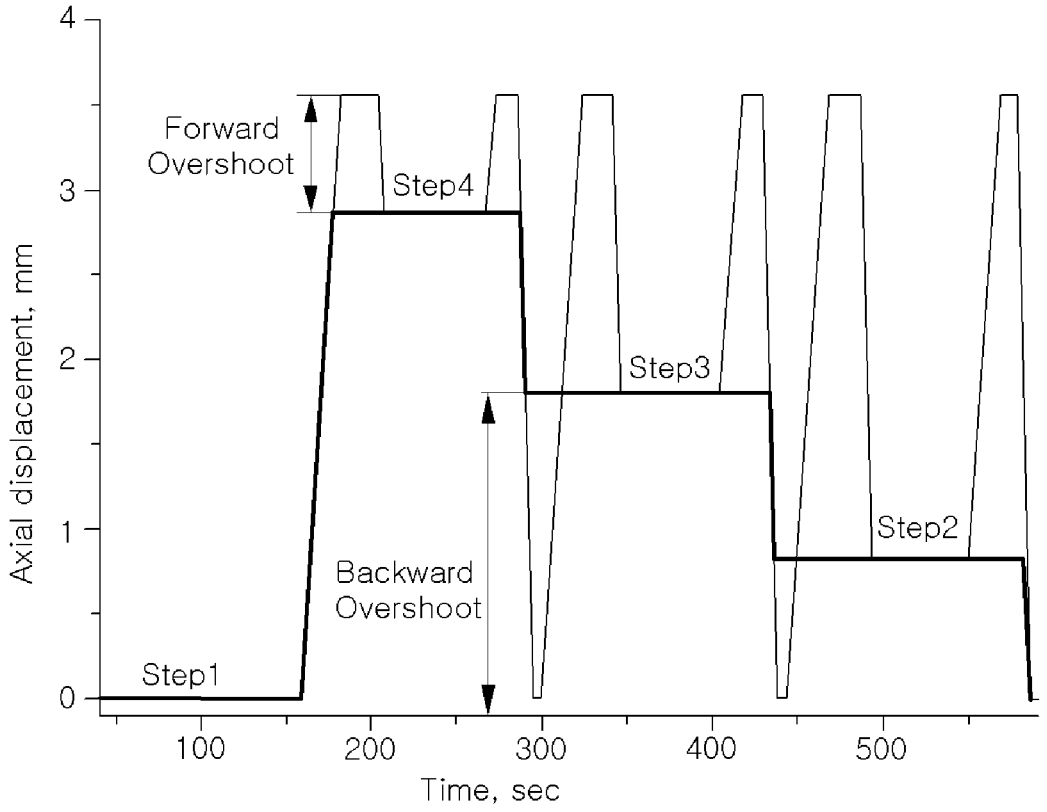
FIG. 1 is a diagram illustrating a state in which an overshoot occurs by a related art clearance adjusting apparatus.

Various modifications may be made to the embodiments of the disclosure, and there may be various types of embodiments. Thus, specific embodiments will be illustrated in drawings, and embodiments will be described in detail in the description. However, it should be noted that the various embodiments are not for limiting the scope of the disclosure to a specific embodiment, but they should be interpreted to include all modifications, equivalents or alternatives of the embodiments included in the ideas and the technical scopes disclosed herein. Meanwhile, in case it is determined that in describing the embodiments, detailed explanation of related known technologies may unnecessarily confuse the gist of the disclosure, the detailed explanation will be omitted.

The terminology used herein is for the purpose of describing particular embodiments only and is not intended to limit the scope of the disclosure. As used herein, the singular forms "a", "an", and "the" are intended to include the plural forms as well, unless the context clearly indicates otherwise. In this specification, terms such as "comprise", "include", or "have/has" should be construed as designating that there are such features, integers, steps, operations, elements, components, and/or a combination thereof in the specification, not to exclude the presence or possibility of adding one or more of other features, integers, steps, operations, elements, components, and/or combinations thereof.

Further, terms such as "first," "second," and so on may be used to describe a variety of elements, but the elements should not be limited by these terms. The terms are used simply to distinguish one element from other elements. The use of such ordinal numbers should not be construed as limiting the meaning of the term. For example, the components associated with such an ordinal number should not be limited in the order of use, placement order, or the like. If necessary, each ordinal number may be used interchangeably.

Hereinafter, a clearance adjusting apparatus and a gas turbine including the same according to exemplary embodiments will be described with reference to the accompanying drawings. In order to clearly illustrate the disclosure in the drawings, some of the elements that are not essential to the complete understanding of the disclosure may be omitted, and like reference numerals refer to like elements throughout the specification.

Figure 2:
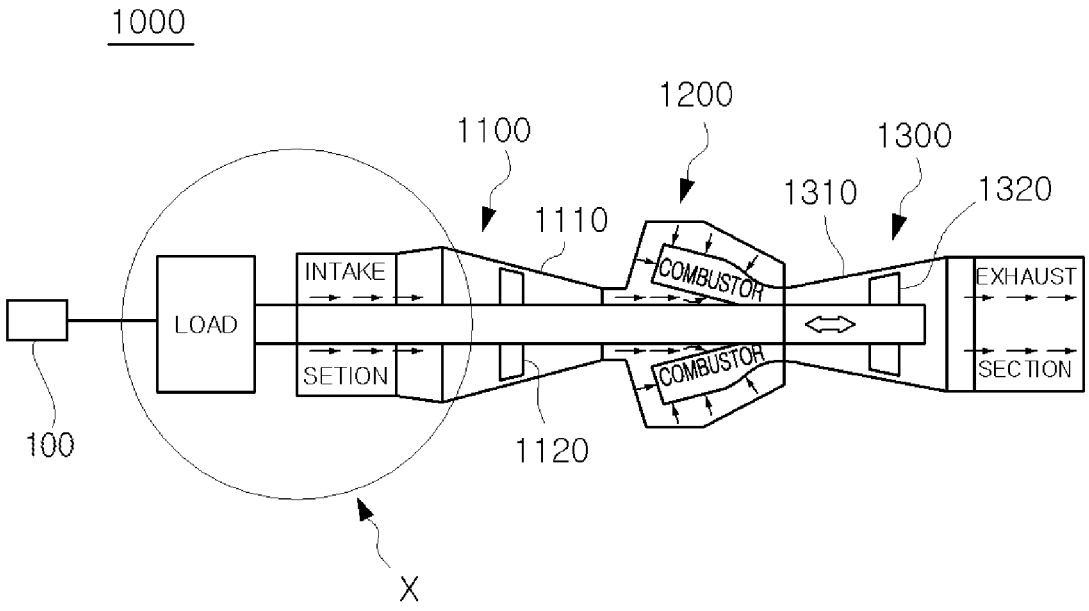
FIG. 2 is a view illustrating a gas turbine according to an exemplary embodiment.
Figure 3:
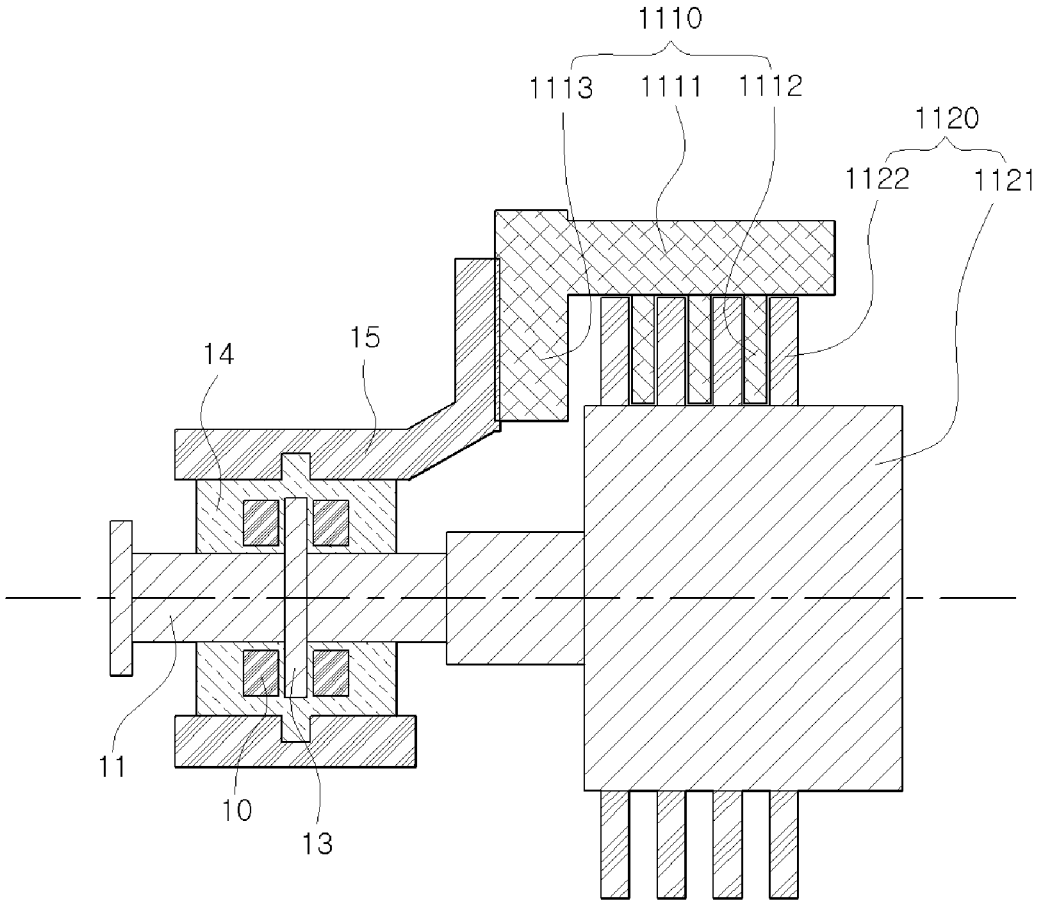
FIG. 3 is an enlarged view of a portion X of FIG. 2.

FIG. 2 is a view illustrating a gas turbine according to an exemplary embodiment, and FIG. 3 is an enlarged view of a portion X of FIG. 2.

Referring to FIGS. 2 and 3, the gas turbine 1000 includes a compressor 1100, a combustor 1200, a turbine 1300, and a clearance adjusting apparatus 100. The turbine 1300 is disposed on a rear side of the compressor 1100, and the combustor 1200 is disposed between the compressor 1100 and the turbine 1300. The clearance adjusting apparatus 100 is installed in front of the compressor 1100.

The compressor 1100 includes compressor vanes 1112 and a compressor rotor 1120 including a compressor disk 1121 and compressor blades 1122 in a compressor casing 1111. The turbine 1300 includes turbine vanes and a turbine rotor 1320 including a turbine disk and turbine blades. The compressor vanes 1112 and the compressor blades 1122 are arranged in a multi-stage along a flow direction of compressed air, and the turbine vanes and the turbine blades are also arranged in a multi-stage along a flow direction of combustion gas. The compressor 1100 has an internal space of which volume decreases from a front-stage toward a rear-stage so that the introduced air can be compressed. In contrast, the turbine 1300 has an internal space of which volume increases from a front-stage toward a rear-stage so that the combustion gas supplied from the combustor 1200 can expand.

The compressor rotor 1120 includes a compressor disk 1121 and a plurality of compressor blades 1122. A plurality of compressor disks 1121 (e.g. 4 compressor disks) may be provided in the compressor casing 1111. The plurality of compressor blades 1122 are radially coupled to an outer circumferential surface of the compressor disk 1121 in the multi-stage. Further, the plurality of compressor vanes 1112 are arranged in the multi-stage on an inner circumferential surface of the compressor casing 1111 such that each stage of compressor vanes 1112 is disposed between adjacent stages of compressor blades 1122. While the compressor rotor disks 1121 rotate along with a rotation of the tie rod, the compressor vanes 1112 fixed to the compressor casing 1111 do not rotate. The compressor vanes 1112 guide the flow of the compressed air moved from front-stage compressor blades 1122 to rear-stage compressor blades 1122. Here, the compressor casing 1111 and the compressor vanes 1112 may be defined as a compressor stator 1110 to distinguish them from the compressor rotor 1120.

Also, the compressor may include a deswirler that serves as a guide vane configured to control an actual inflow angle of the fluid entering into an inlet of the combustor so that the actual inflow angle matches a designed inflow angle.

The combustor 1200 mixes the introduced compressed air with fuel and combusts the air-fuel mixture to produce high-temperature and high-pressure combustion gas with high energy, thereby raising the temperature of the combustion gas to a temperature at which the combustor and the turbine are able to be resistant to heat through an isothermal combustion process.

A plurality of combustors constituting the combustor 1200 may be arranged in a form of a cell in a combustor casing. Each combustor includes a nozzle for injecting fuel, a liner defining a combustion chamber, and a transition piece serving as a connector between the combustor and the turbine.

The liner provides a combustion space in which fuel injected from a fuel nozzle is mixed with the compressed air supplied from the compressor and burned. The liner includes a combustion chamber that provides the combustion space in which the fuel-air mixture is burned, and an annular flow path that surrounds the combustion chamber to provide an annular space. The fuel injection nozzle is coupled to a front side of the liner, and an igniter is coupled to a sidewall of the liner.

In the annular flow path, the compressed air introduced through a plurality of holes provided in an outer wall of the liner flows, and the compressed air that cooled the transition piece also flows. Therefore, as the compressed air flows along the outer wall of the liner, it is possible to prevent the liner from being thermally damaged by high temperature combustion gas.

The transition piece is connected to a rear side of the liner to deliver the combustion gas toward the turbine. The transition piece includes an annular flow path surrounding an inner space of the transition piece. As the compressed air flows along the annular flow path, an outer wall of the transition piece is cooled by the compressed air to prevent damage by high temperature e combustion gas.

The turbine 1300 is basically similar in structure to the compressor 1100. That is, the turbine 1300 may include a plurality of turbine rotors 1320 similar to the compressor rotor 1120 of the compressor 1100. The turbine rotor 1320 includes a turbine disk and a plurality of turbine blades radially disposed around the turbine disk. The plurality of turbine vanes are annually arranged in a multi-stage on an inner circumferential surface of a turbine casing such that each stage of turbine vanes is disposed between adjacent stages of turbine blades to guide a flow direction of the compressed air passing through the turbine blades. Here, the turbine casing and the turbine vanes may be defined as a turbine stator 1310 to distinguish them from the turbine rotor 1320.

Referring to FIG. 3, the gas turbine 1000 further includes a shaft 11, a thrust bearing 10, a thrust collar 13, a support 14, and a fastener 15, in front of the compressor 1100. The shaft 11 is coupled to a front side of the compressor disk 1121 so that the shaft 11 rotates together with the compressor disk 1121. The support 14 is disposed around an outer circumferential surface of the shaft 11. The thrust bearing 10 supports the support 14 such that the support 14 is rotatable with respect to the shaft 11. The thrust collar 13 supports the support 14. The fastener 15 is disposed to surround the support 14 such that a rear side thereof is fixed to a protruding member 1113 protruding inward from the front side of the compressor casing 1111.

Figure 4:
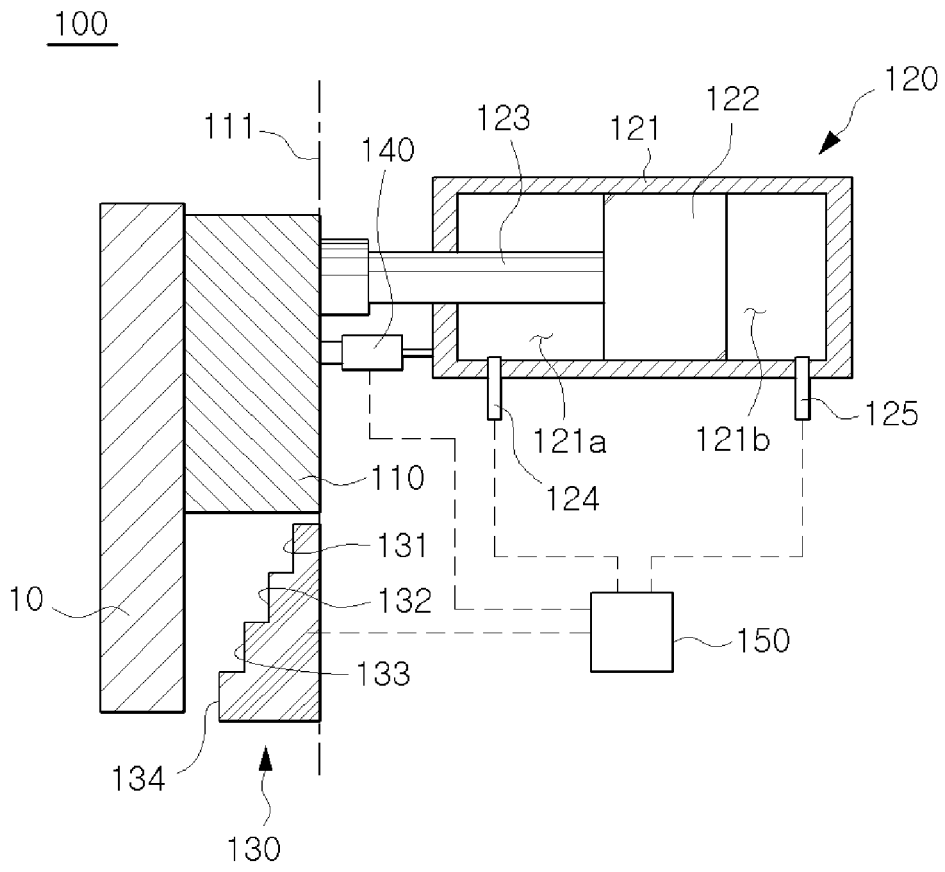
FIG. 4 is a view illustrating a clearance adjusting apparatus according to a first exemplary embodiment installed on a thrust bearing illustrated in FIG. 3.
Figure 5:
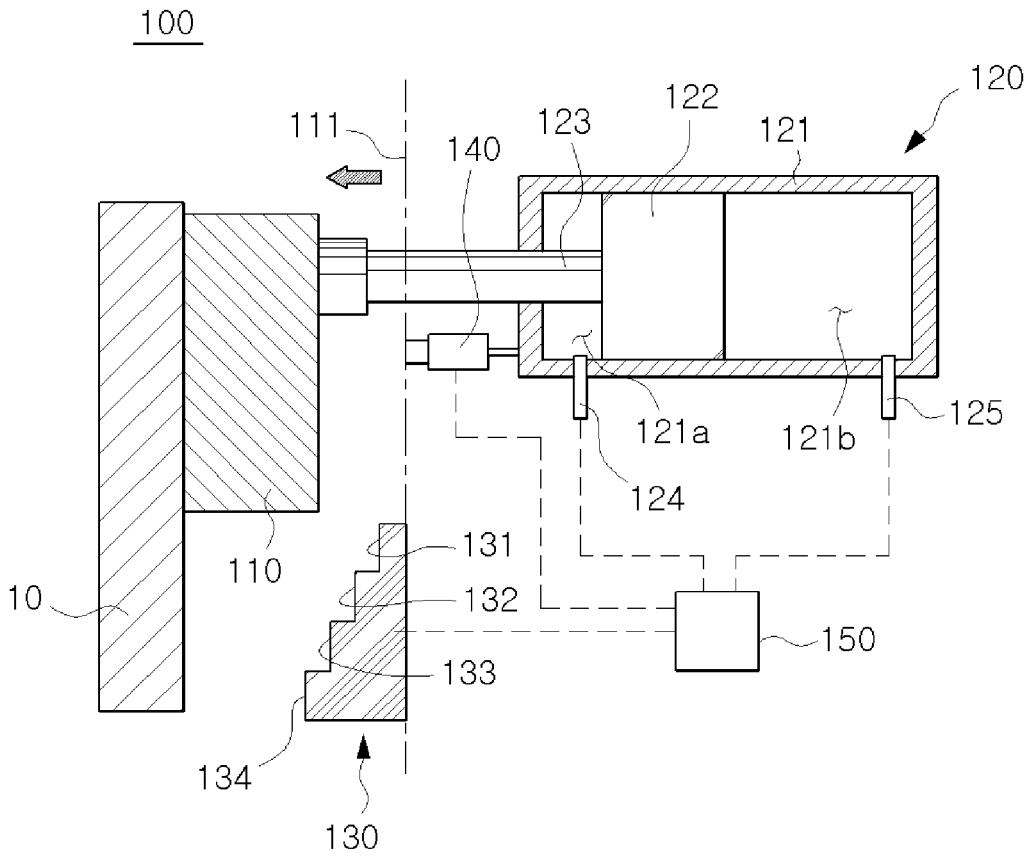
FIG. 5 is a view illustrating a state in which an adjusting plate is being moved forward from the state of FIG. 4.
Figure 6:
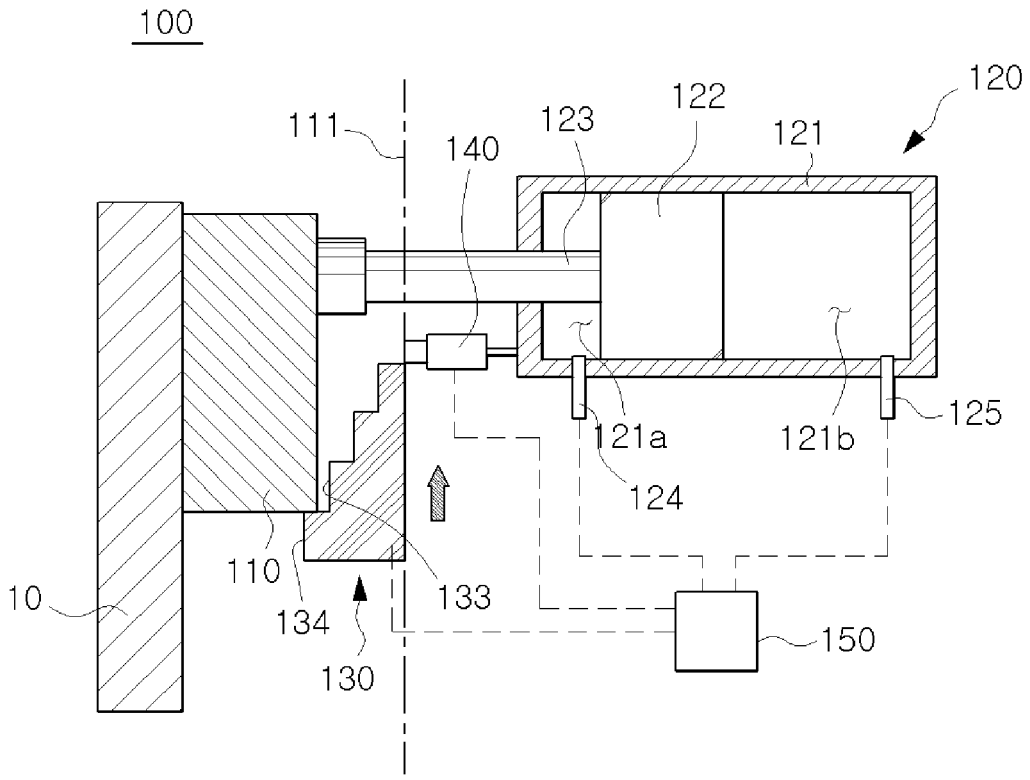
FIG. 6 is a view illustrating a state in which a stopper being raised after the state of FIG. 5.
Figure 7:
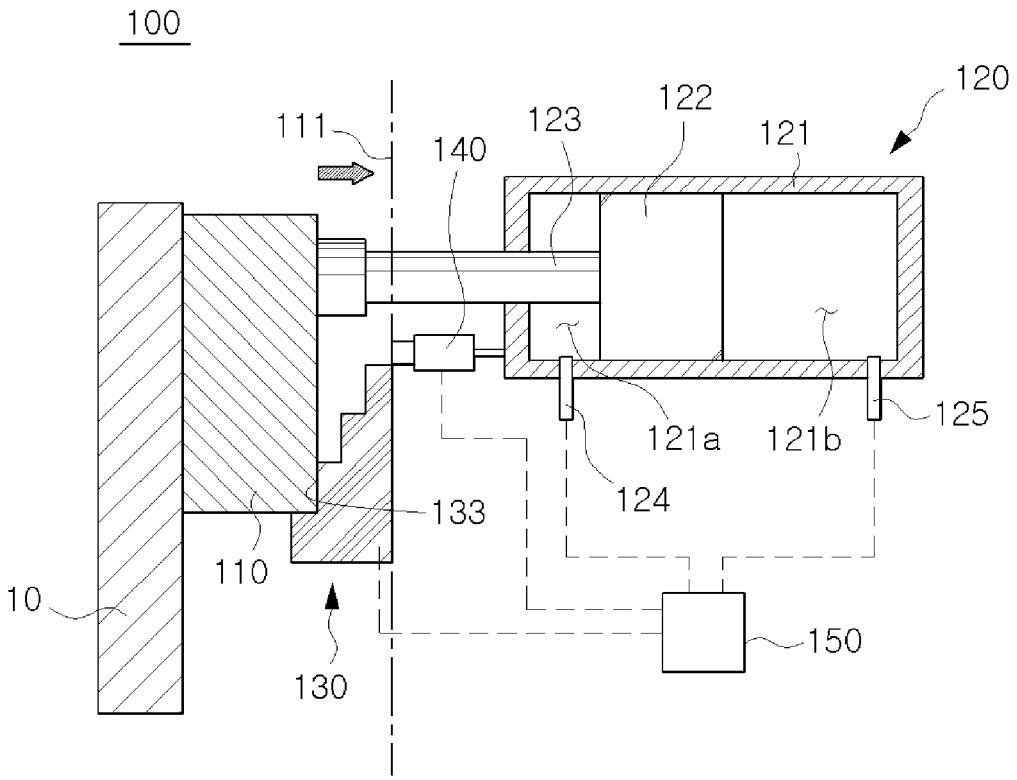
FIG. 7 is a view illustrating a state in which the adjusting plate is moved rearward and seated on the stopper after the state of FIG. 6.

FIG. 4 is a view illustrating a clearance adjusting apparatus according to a first exemplary embodiment installed on a thrust bearing, FIG. 5 is a view illustrating a state in which an adjusting plate is being moved forward from the state of FIG. 4, FIG. 6 is a view illustrating a state in which a stopper being raised, and FIG. 7 is a view illustrating a state in which the adjusting plate is moved backward and seated on the stopper. Here, an upstream direction of a combustion gas, that is, a direction from the turbine 1300 toward the compressor 1100 in FIG. 2 is referred to as a forward direction, and a downstream direction of the combustion gas, that is, a direction from the compressor 1100 toward the turbine 1300 is referred to as a rearward direction. In FIGS. 4 to 7, a direction toward a left side, that is, a direction to which a biasing cylinder 120 pushes an adjusting plate 110 is the forward direction, and a direction toward a right side, that is, a direction to which the biasing cylinder 120 pulls the adjusting plate 110 is the rearward direction. In addition, in a direction perpendicular to the forward-rearward (i.e., a longitudinal or an axial) direction, a direction in which a stopper 130 moves toward the adjusting plate 110 is an upward direction and a direction in which the stopper 130 moves away from the adjusting plate 110 is a downward direction.

Referring to FIGS. 4 to 7, the clearance adjusting apparatus 100 is designed to move the thrust bearing 10 back and forth in order to adjust a tip clearance formed between an inner circumferential surface of the turbine casing and a distal end of the turbine blade. When the thrust bearing 10 is moved back and forth, the shaft 11, the compressor rotor 1120, and the turbine rotor 1320 are also moved back and forth. Therefore, the clearance adjusting apparatus 100 can adjust the tip clearance in a turbine. Here, a compressor tip clearance formed between the compressor casing 1111 and the compressor blade 1122 may also be adjusted.

The clearance adjusting apparatus 100 includes an adjusting plate 110, a biasing cylinder 120, a stopper 130, a position sensor 140, and a controller 150.

The adjusting plate 110 is installed on the thrust bearing 10 to move forward from or move rearward to a reference surface 111. The reference surface 111 may be a virtual plane on which the adjusting plate 110 is initially disposed.

The biasing cylinder 120 which is hydraulically operated is disposed on a rear side of the adjusting plate 110 to selectively move the adjusting plate 110 forward or rearward. To this end, the biasing cylinder 120 includes a housing 121, a division part 122, a biasing part 123, a front supply part 124, and a rear supply part 125. The housing 121 has a hollow cylindrical shape. The division part 122 is disposed inside the housing 121 to reciprocate back and forth. In addition, the division part 122 is arranged perpendicular to the forward-rearward direction so that an interior of the housing 121 is divided into a front space 121*a* and a rear space 121*b*.

The biasing part 123 is a rod-shaped member that extends in the forward-rearward direction such that one end is coupled to a front side of the division part 122 and the other end is coupled to a rear surface of the adjusting plate 110. In addition, the biasing part 123 moves the adjusting plate 110 back and forth. The front supply part 124 is disposed on the housing 121 to communicate with the front space 121*a*, and the rear supply part 125 is disposed on the housing 121 to communicate with the rear space 121*b*. Through the front supply part 124 and the rear supply part 125, fluid flows between an external environment and the front space 121*a* or the rear space 121*b*.

When the adjusting plate 110 is to be moved forward, fluid is supplied to the rear space 121*b* through the rear supply part 125. In this case, a fluid pressure in the rear space 121*b* is biased toward a rear surface of the division part 122, so that the division part 122, the biasing part 123, and the adjusting plate 110, which were connected together, are moved forward. In contrast, when the adjusting plate 110 is to be moved rearward, fluid is supplied to the front space 121*a* through the front supply part 124. In this case, a fluid pressure in the front space 121*a* is biased toward a front surface of the division part 122, so that the division part 122, the biasing part 123, and the adjusting plate 110, which were connected together, are moved rearward.

The stopper 130 is disposed under and adjacent to the adjusting plate 110 such that a rear surface thereof is placed on the reference surface 111. After the adjusting plate 110 is moved forward, the stopper 130 is raised toward the adjusting plate 110. After the stopper 130 is raised, the adjusting plate 110 is moved rearward and is seated on the stopper 130. That is, the stopper 130 may be moved up and down in a state of the rear surface thereof being placed on the reference surface 111.

The stopper 130 has a front stepped surface on which a plurality of step faces are formed at different distances from the reference surface 111. FIG. 4 shows four step faces, and it is understood that more or less than 4 step faces may be included in one or more other embodiments. The step faces include a first step face 131, a second step face 132, a third step face 133, and a fourth step face 134. The first step face 131 is disposed on an uppermost side of the step faces. The second step face 132 is disposed below the first step face 131 to protrude more forward than the first step face 131 from the reference surface 111. The third step face 133 is disposed below the second step face 132 to protrude more forward than the second step face 132 from the reference surface 111. The fourth step face 134 is disposed below the third step face 133 to protrude more forward than the third step face 133 from the reference surface 111.

The position sensor 140 is disposed in front of the housing 121 to measure a distance from the reference surface 111 to the rear surface of the adjusting plate 110. That is, the position sensor 140 measures a distance of the adjusting plate 110 spaced from the reference surface 111.

The controller 150 externally receives information about a displacement of the thrust bearing 10 and receives information about measurements from the position sensor 140. The controller 150 controls an operation of the stopper 130 and the biasing cylinder 120 based on the received information. That is, the controller 150 controls an opening and closing of the front supply part 124 and the rear supply part 125 to regulate a flow rate of fluid supplied to the front space 121*a* and the rear space 121*b*, thereby controlling the forward and rearward movements of the biasing part 123. In addition, the controller 150 controls the adjusting plate 110 and the stopper 130 so that the adjusting plate 110 is seated on a target one of the step faces 131, 132, 133, and 134, by moving the adjusting plate 110 forward, raising the stopper 130, and moving the adjusting plate 110 rearward. Accordingly, the controller 150 allows the tip clearance of the turbine 1300 to be optimally adjusted.

Hereinafter, a detailed description of an operation of the adjusting plate 110, the biasing cylinder 120, and the stopper 130, which is performed by the controller 150, is provided with reference to FIGS. 5 to 7. Here, a final displacement of the adjusting plate 110 to the reference surface 111 to be performed as a target movement by the controller 150 is referred to as a target displacement.

Referring to FIG. 5, the controller 150 receives information about the target displacement and selects, among the plurality of step faces 131, 132, 133, and 134, a step face that is spaced apart from the reference surface 111 a distance corresponding to the target displacement. Here, it is assumed that the selected step face is the third step face 133. The controller 150 controls the division part 122, the biasing part 123, and the adjusting plate 110 to move forward, after opening the rear supply part 125 so that a fluid flows into the rear space 121*b*.

The position sensor 140 measures a moving distance of the adjusting plate 110 advanced by the biasing cylinder 120 in real time. Further, the controller 150 controls to stop the forward movement of the adjusting plate 110 if a distance from the reference surface 111 to the rear surface of the adjusting plate 110 is greater than a distance from the reference surface 111 to the selected step face and smaller than a distance from the reference surface 111 to the step face disposed below the selected step face. Here, the selected step face becomes the third step face 133, and the step face disposed below the selected step face becomes the fourth step face 134.

For example, the controller 150 controls to stop the forward movement of the adjusting plate 110 if the distance from the reference surface 111 to the rear surface of the adjusting plate 110 becomes a value that corresponds to 'the distance to the selected step face, i.e. the third step face 133 plus (+) a preset reference distance value'.

The controller 150 receives information about distances of the first to fourth step faces 131 to 134 from the reference surface 111. In addition, the controller 150 also receives input information about distance differences between the step faces 131 to 134, i.e., between adjacent step faces among the step faces 131 to 134. The preset reference distance value may correspond to a positive number that is smaller than the difference between a distance value of the fourth step face 134 from the reference surface 111 and a distance value of the third step face 133 from the reference surface 111. The preset reference distance value may be set based on an operating state, operating conditions, etc. of the gas turbine 1000.

Referring to FIG. 6, the controller 150 controls to raise the stopper 130 after stopping the forward movement of the adjusting plate 110. At this time, the controller 150 controls to raise the stopper 130 such that an upper surface of the step face directly below the selected step face becomes flush with a lower surface of the adjusting plate 110. For example, the controller 150 controls to raise the stopper 130 such that an upper surface of the fourth step face 134, i.e., a surface connecting the third step face 133 and the fourth step face 134 in the forward-rearward direction, becomes flush with the lower surface of the adjusting plate 110.

Thereafter, referring to FIG. 7, the controller 150 controls to move the adjusting plate 110 rearward so that the adjusting plate 110 is seated on the third step face 133.

As described above, in the clearance adjusting apparatus 100 and the gas turbine 1000 having the same according to the exemplary embodiment, an overshoot phenomenon in which the thrust bearing 10 is moved beyond a target distance to be originally moved is prevented from occurring by measuring the displacement of the adjusting plate 110 using the position sensor 140 in real time, and controlling the movement of the adjusting plate 110 based on the measurements. Therefore, according to the clearance adjusting apparatus 100 and the gas turbine 1000 having the same, the tip clearance of the turbine 1300 can be optimally maintained, and an overall driving efficiency of the gas turbine 1000 can be improved.

Figure 8:
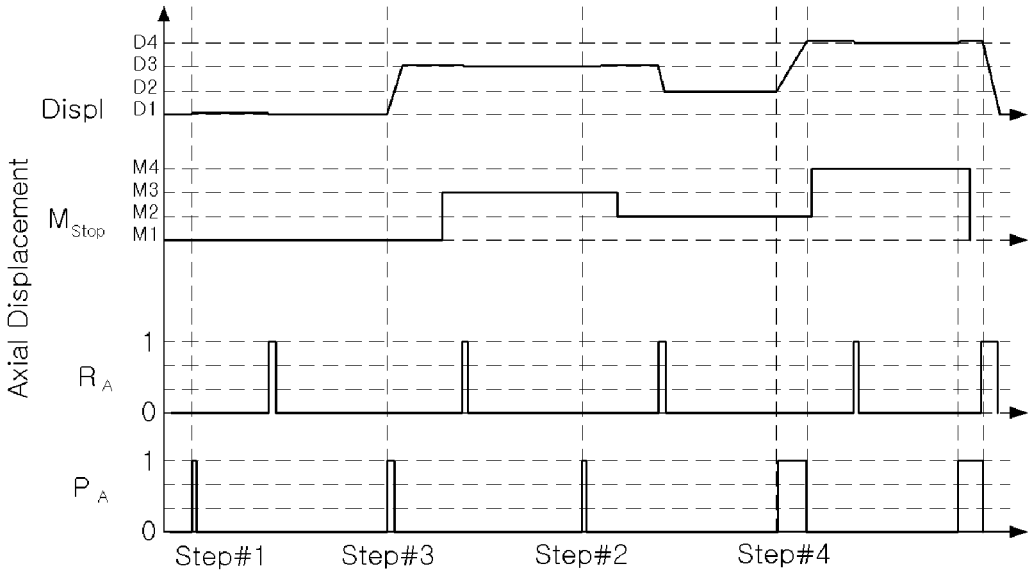
FIG. 8 is a graph illustrating an operation of the clearance adjusting apparatus illustrated in FIG. 4.

FIG. 8 is a graph illustrating an operation of the clearance adjusting apparatus 100 according to an exemplary embodiment. Here, a third step Step #3, that is, a step in which the adjusting plate 110 is seated on the third step face 133 will be described. Referring to FIG. 8, an abscissa axis denotes a time, an ordinate axis $D_{ispl}$ denotes the displacement of the adjusting plate 110, an ordinate axis $M_{stop}$ denotes the displacement of the stopper 130, an ordinate axis $R_A$ denotes a flow rate of fluid supplied to the front space 121*a* through the front supply part 124, and an ordinate axis $P_A$ denotes a flow rate of fluid supplied to the rear space 121*b* through the rear supply part 125.

First, in the third step Step #3, as the rear supply part 125 is opened, a fluid is supplied to the rear space 121*b* through the rear supply part 125. At this time, the front supply part 124 maintains a closed state. When the rear supply part 125 is opened, the adjusting plate 110 is moved forward a distance that corresponds to 'the target displacement D3 plus the preset reference distance value'. When the forward movement of the adjusting plat 110 is completed, the rear supply part 125 is immediately closed.

Next, the stopper 130 is raised to a position M3 in which an upper surface of the fourth step face 134 becomes flush with the lower surface of the adjusting plate 110. Then, the front supply part 124 is opened so that a fluid is supplied to the front space 121*a*. Here, a duration time of the front supply part 124 being opened is much shorter than a duration time of the rear supply part 125 being opened. Therefore, a flow rate of fluid biasing the adjusting plate 110 rearward through opening of the front supply part 124 is much smaller than a flow rate of fluid biasing the adjusting plate 110 forward through opening of the rear supply part 125.

During the duration time of the front supply part 124 being opened, the adjusting plate 110 is moved rearward by the preset reference distance value. Then, the adjusting plate 110 is seated on the third step face 133. Through this process, the clearance adjusting apparatus 100 completes the operation of adjusting the tip clearance of the turbine 1300 as originally intended.

Hereinafter, a clearance adjusting apparatus according to a second exemplary embodiment will be described with reference to FIGS. 9 and 10A to 10C. Here, a description will only be made of configurations that are different from the first exemplary embodiment.

Figure 9:
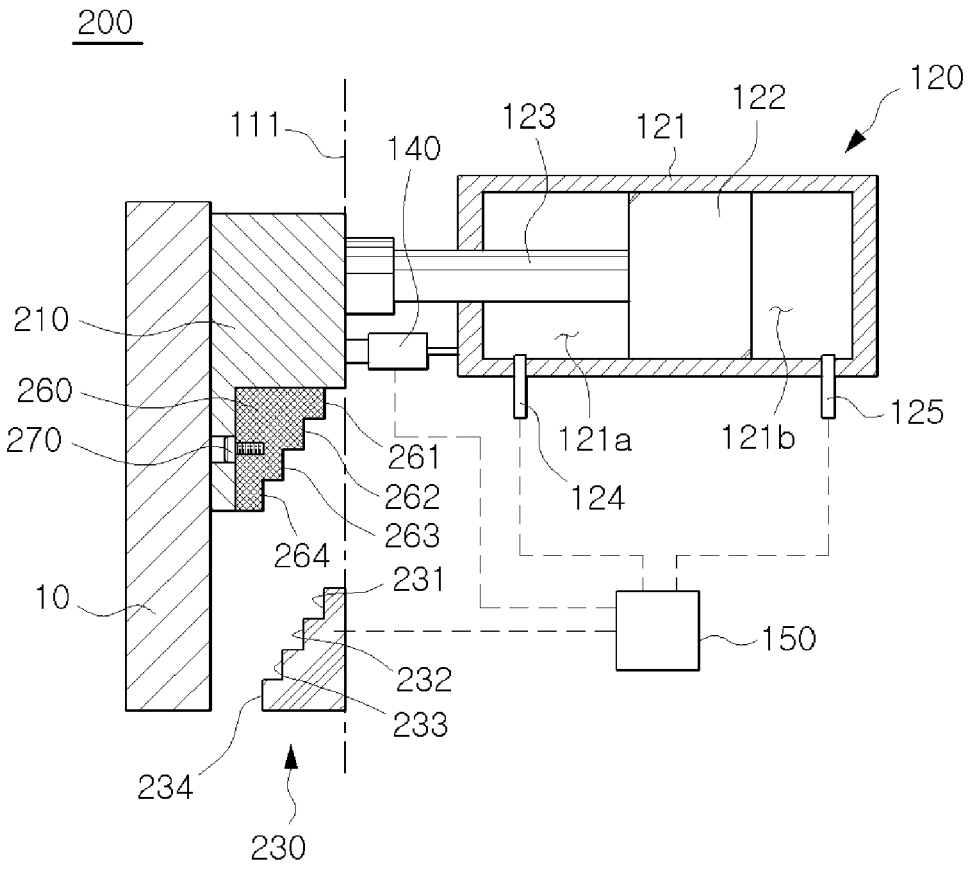
FIG. 9 is a view illustrating a clearance adjusting apparatus according to a second exemplary embodiment.
Figure 10A:
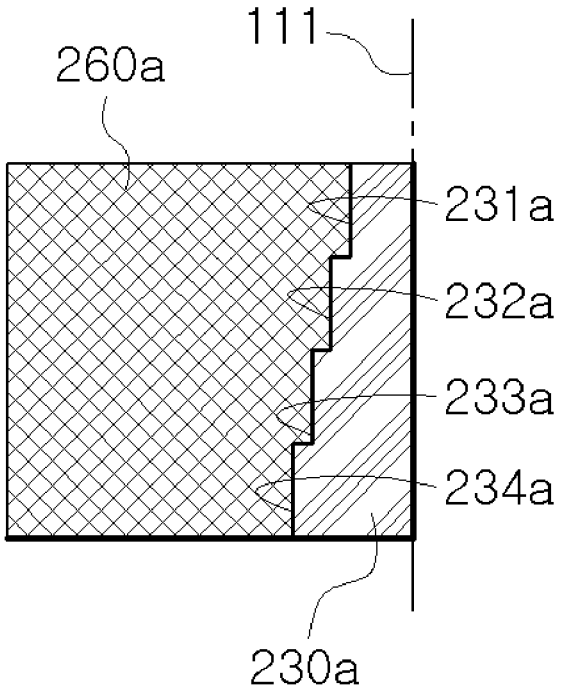
FIGS. 10A, 10B, and 10C are views illustrating various modifications of the stopper and a fastener illustrated in FIG. 9.
Figure 10B:
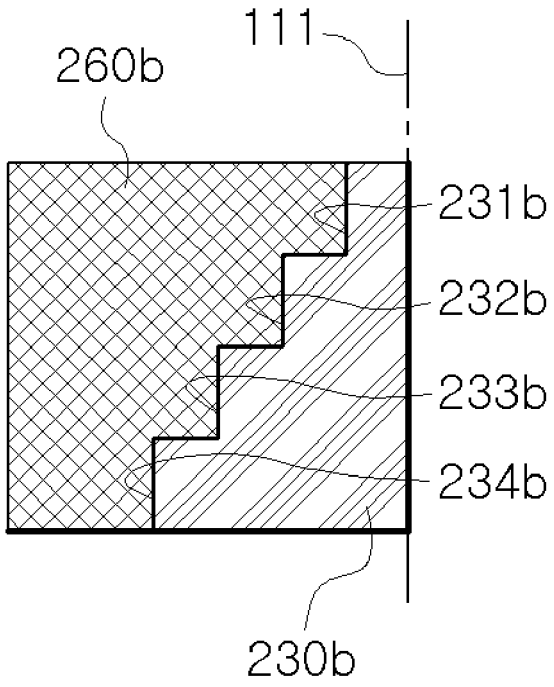
Figure 10C:
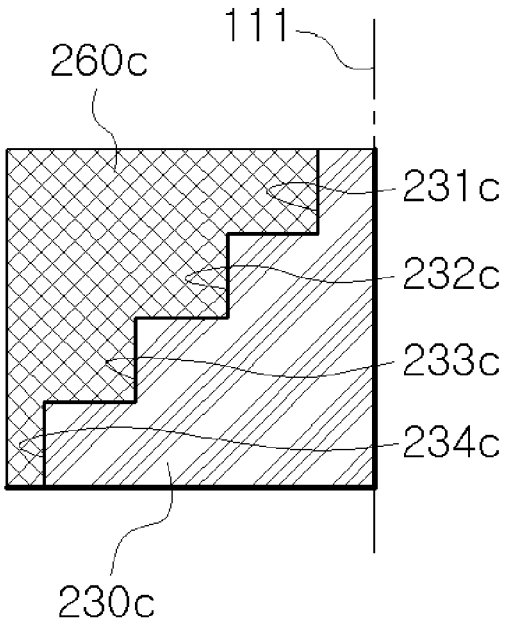

Referring to FIGS. 9 to 10C, a clearance adjusting apparatus 200 may further include a fastening member 260 and a fastening bolt 270. The fastening member 260 is disposed under an adjusting plate 210. The fastening member 260 includes a stepped surface having a plurality of step contact faces 261, 262, 263, and 264 that respectively correspond to a plurality of step faces 231, 232, 233, and 234 of a stopper 230. The plurality of step contact faces 261, 262, 263, and 264 of the fastening member 260 are respectively seated on the plurality of step faces 231, 232, 233, and 234 of the stopper 230, such that the forward or rearward displacement of the adjusting plate 210 with respect to the reference surface 111 is controlled and the tip clearance of the turbine 1300 is also adjusted.

Here, the plurality of step contact faces 261, 262, 263, and 264 and the plurality of step faces 231, 232, 233, and 234 may have faces that do not contact each other. For example, when the third step contact face 263 is seated on the first step face 231, the first and second step contact faces 261 and 262 are not in contact with any of the step faces 231, 232, 233, and 234. At this time, the third step face 233 and the fourth step face 234 are not in contact with any of the contact faces 261, 262, 263, and 264.

The fastening bolt 270 penetrates into the fastening member 260 through a front side of the adjusting plate 210, thereby fastening the fastening member 260 to the adjusting plate 210.

A distance from the reference surface 111 to the step faces 231 to 234 of the stopper 230 determines a forward displacement of the adjusting plate 210 from the reference surface 111. This will also determine the tip clearance of the turbine 1300. That is, as illustrated in FIG. 10A, when respective displacements of the step faces 231*a* to 234*a* from the reference surface 111 are relatively small, back-forth distances of the adjusting plate 210 to be adjusted by the stopper 230 becomes smaller so that a variation in the tip clearance of the turbine 1300 is also maintained to be small.

On the contrary, as illustrated in FIG. 10C, when respective displacements of the step faces 231*c* to 234*c* from the reference surface 111 are relatively large, back-forth distances of the adjusting plate 210 to be adjusted by the stopper 230 becomes larger so that a variation in the tip clearance of the turbine 1300 is also maintained to be large.

Therefore, as illustrated in FIGS. 10A, 10B, and 10C, the tip clearance of the turbine 1300 can be varied as intended by installing the fastening member 260*a*, 260*b*, and 260*c* corresponding to the target variation in the tip clearance of the turbine 1300 on the adjusting plate 210 and providing the stopper 230*a*, 230*b*, and 230*c* corresponding to the fastening member 260*a*, 260*b*, and 260*c*.

On the other hand, a washer plate may be interposed between the adjusting plate 210 and the fastening member 260 in which the fastening bolt 270 is inserted. The washer plate may serve to adjust the distance between the adjusting plate 210 and the fastening member 260, and to allow the fastening member 260 to be more firmly fastened to the adjusting plate 210 by the fastening bolt 270.

While not restricted thereto, an exemplary embodiment can be embodied as computer-readable code on a computer-readable recording medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network-coupled computer systems so that the computer-readable code is stored and executed in a distributed fashion. Also, an exemplary embodiment may be written as a computer program transmitted over a computer-readable transmission medium, such as a carrier wave, and received and implemented in general-use or special-purpose digital computers that execute the programs. Moreover, it is understood that in exemplary embodiments, one or more units of the above-described apparatuses and devices can include circuitry, a processor, a microprocessor, etc., and may execute a computer program stored in a computer-readable medium.

While one or more exemplary embodiments have been described with reference to the accompanying drawings, it is to be understood by those skilled in the art that various modifications and changes in form and details may be made therein without departing from the spirit and scope as defined by the appended claims. Accordingly, the description of the exemplary embodiments should be construed in a descriptive sense only and not to limit the scope of the claims, and many alternatives, modifications, and variations will be apparent to those skilled in the art.

What is claimed is:

1. A clearance adjusting apparatus to move a thrust bearing of a gas turbine back and forth to adjust a tip clearance of a turbine, the clearance adjusting apparatus comprising:

an adjusting plate disposed on the thrust bearing to move forward from or rearward to a reference surface;

a biasing cylinder disposed on a rear side of the adjusting plate to selectively move the adjusting plate back and forth;

a stopper disposed adjacent to the adjusting plate to be moved toward the adjusting plate after being moved forward to prevent a rearward movement of the adjusting plate;

a position sensor disposed on the biasing cylinder to measure a distance from the reference surface to a rear surface of the adjusting plate; and a controller configured to receive information about measurements from the position sensor and control an operation of the stopper and the biasing cylinder based on the received information.

2. The clearance adjusting apparatus according to claim 1, wherein the biasing cylinder comprises:

a housing;

a division part disposed inside the housing to reciprocate back and forth such that the division part is arranged to divide an interior space of the housing into a front space and a rear space; and a biasing part connected between a front side of the division part and a rear surface of the adjusting plate to move the adjusting plate back and forth.

3. The clearance adjusting apparatus according to claim 2, wherein the position sensor is disposed in front of the housing.

4. The clearance adjusting apparatus according to claim 3, wherein the biasing cylinder further comprises a front supply part and a rear supply part through which a fluid flows into and out of the front space and the rear space, respectively, and the controller is configured to supply a fluid to the rear space through the rear supply part if the division part is to be moved forward and to supply a fluid to the front space through the front supply part if the division part is to be moved rearward.

5. The clearance adjusting apparatus according to claim 1, wherein the stopper is disposed under the adjusting plate such that a rear surface thereof is placed on the reference surface, the stopper having a front stepped surface on which a plurality of step faces are formed at different distances from the reference surface, and the controller is configured to seat the adjusting plate on a target step face by moving the adjusting plate forward, raising the stopper, and moving the adjusting plate rearward.

6. The clearance adjusting apparatus according to claim 5, wherein the stopper is configured such that an underlying step face protrudes more forward from an overlying step face thereof, and the controller is configured to select, from the step faces of the stopper, a step face having a distance from the reference surface corresponding to a target displacement of the adjusting plate from the reference surface, and seat the adjusting plate on the selected step face.

7. The clearance adjusting apparatus according to claim 6, wherein the controller is configured to stop the forward movement of the adjusting plate and raise the stopper if a distance from the reference surface to the rear surface of the adjusting plate is greater than a distance from the reference surface to the selected step face and is smaller than a distance from the reference surface to the step face disposed below the selected step face.

8. The clearance adjusting apparatus according to claim 7, wherein the controller is configured to raise the stopper such that an upper surface of the step face below the selected step face becomes flush with a lower surface of the adjusting plate, and move the adjusting plate rearward so that the adjusting plate is seated on the selected step face.

9. The clearance adjusting apparatus according to claim 5, further comprising a fastening member disposed under the adjusting plate and having a stepped surface with a plurality of step contact faces to be selectively brought into contact with the plurality of step faces of the stopper, respectively.

10. The clearance adjusting apparatus according to claim 9, further comprising a fastening bolt to fasten the fastening member and the adjusting plate together through the adjusting plate.

11. A gas turbine comprising:

a compressor including a compressor stator into which air is externally introduced and a compressor rotor disposed in the compressor stator to compress the air;

a combustor configured to mix the compressed air with fuel and combust the air and fuel mixture;

a turbine including a turbine stator through which the combustion gas supplied from the combustor flows and a turbine rotor disposed in the turbine stator to rotate with the combustion gas flowing therethrough;

a shaft disposed in front of the compressor rotor;

a thrust bearing disposed around an outer circumferential surface of the shaft; and a clearance adjusting apparatus disposed on the thrust bearing to move the thrust bearing back and forth so that the shaft, the compressor rotor, and the turbine rotor are moved back and forth, wherein the clearance adjusting apparatus comprises:

an adjusting plate disposed on the thrust bearing to move forward from or rearward to a reference surface;

a biasing cylinder disposed on a rear side of the adjusting plate to selectively move the adjusting plate back and forth;

a stopper disposed adjacent to the adjusting plate to be moved toward the adjusting plate after being moved forward to prevent a rearward movement of the adjusting plate;

a position sensor disposed on the biasing cylinder to measure a distance from the reference surface to a rear surface of the adjusting plate; and a controller configured to receive information about measurements from the position sensor and control an operation of the stopper and the biasing cylinder based on the received information.

12. The gas turbine according to claim 11, wherein the biasing cylinder comprises:

a housing;

a division part disposed inside the housing to reciprocate back and forth such that the division part is arranged to divide an interior space of the housing into a front space and a rear space; and a biasing part connected between a front side of the division part and a rear surface of the adjusting plate to move the adjusting plate back and forth.

13. The gas turbine according to claim 12, wherein the position sensor is disposed in front of the housing.

14. The gas turbine according to claim 13, wherein the biasing cylinder further comprises a front supply part and a rear supply part through which a fluid flows into and out of the front space and the rear space, respectively, and the controller is configured to supply a fluid to the rear space through the rear supply part if the division part is to be moved forward and to supply a fluid to the front space through the front supply part if the division part is to be moved rearward.

15. The gas turbine according to claim 11, wherein the stopper is disposed under the adjusting plate such that a rear surface thereof is placed on the reference surface, the stopper having a front stepped surface on which a plurality of step faces are formed at different distances from the reference surface, and the controller is configured to seat the adjusting plate on a target step face by moving the adjusting plate forward, raising the stopper, and moving the adjusting plate rearward.

16. The gas turbine according to claim 15, wherein the stopper is configured such that an underlying step face protrudes more forward from an overlying step face thereof, and the controller is configured to select, from the step faces of the stopper, a step face having a distance from the reference surface corresponding to a target displacement of the adjusting plate from the reference surface, and seat the adjusting plate on the selected step face.

17. The gas turbine according to claim 16, wherein the controller is configured to stop the forward movement of the adjusting plate and raise the stopper if a distance from the reference surface to the rear surface of the adjusting plate is greater than a distance from the reference surface to the selected step face and is smaller than a distance from the reference surface to the step face disposed below the selected step face.

18. The gas turbine according to claim 17, wherein the controller is configured to raise the stopper such that an upper surface of the step face below the selected step face becomes flush with a lower surface of the adjusting plate, and move the adjusting plate rearward so that the adjusting plate is seated on the selected step face.

19. The gas turbine according to claim 15, wherein the clearance adjusting apparatus further comprises a fastening member disposed under the adjusting plate and having a stepped surface with a plurality of step contact faces to be selectively brought into contact with the plurality of step faces of the stopper, respectively.

20. The gas turbine according to claim 19, wherein the clearance adjusting apparatus further comprises a fastening bolt to fasten the fastening member and the adjusting plate together through the adjusting plate.

* * * * *